United States Patent [19]

Kitchen

[11] Patent Number: 4,640,674

[45] Date of Patent: Feb. 3, 1987

[54] PULSE COMBUSTION APPARATUS

[75] Inventor: John A. Kitchen, Hastings, Canada

[73] Assignee: John A. Kitchen Ltd., Hastings, Canada

[21] Appl. No.: 815,488

[22] Filed: Jan. 2, 1986

[51] Int. Cl.[4] ..... F23C 11/04

[52] U.S. Cl. ..... 431/1; 431/189; 60/39.76

[58] Field of Search ..... 431/1, 158, 189, 354; 60/247, 249, 39.76, 39.77; 122/24; 432/25

[56] References Cited

U.S. PATENT DOCUMENTS 4,336,791 6/1982 Kitchen ..... 431/1 X

FOREIGN PATENT DOCUMENTS 807978 3/1969 Canada ..... 431/1

544827 2/1977 U.S.S.R. ..... 431/1

*Primary Examiner*—Randall L. Green

*Attorney, Agent, or Firm*—Rogers, Bereskin & Parr

[57] ABSTRACT

A pulse combustion apparatus capable of operating using a variety of different fuels includes an exchangeable fuel supply nozzle disposed adjacent a primary air inlet valve and separated from secondary air inlet valves by baffle means. The baffle means co-operates with the nozzle to define a metering orifice through which the primary air flows. The size of the orifice is determined by the axial position of the nozzle so that nozzles for different fuels can be positioned in axially different positions to meter the primary air as required to maintain continuous combustion commensurate with a pulse cycle of reasonable strength.

11 Claims, 4 Drawing Figures

PULSE COMBUSTION APPARATUS

FIELD OF THE INVENTION

This invention relates generally to pulse combustion apparatus.

BACKGROUND OF THE INVENTION

Typically, a pulse combustion apparatus includes a combustion chamber and an exhaust pipe which forms a resonant system with the combustion chamber. The apparatus operates on a cycle in which a fuel charge is admitted to the combustion chamber and ignited. The charge then expands into the exhaust pipe causing a partial vacuum in the combustion chamber, which both assists in drawing in a fresh fuel charge and causes high temperature gas to be drawn back into the combustion chamber from the exhaust pipe. The fresh fuel charge ignites spontaneously thereby establishing the next cycle. Accordingly, operation of the apparatus is self-sustaining after initial ignition. An example of a practial application of this type of apparatus is as a heater, for example in a boiler or for air heating.

DESCRIPTION OF THE PRIOR ART

Examples of pulse combustion apparatus used primarily for heating water are shown in my U.S. Pat. Nos. 3,267,985, 4,241,720 and 4,241,723. Examples of pulse combustion apparatus used for heating air are shown in my U.S. Pat. Nos. 2,916,032 and 4,309,977. Other examples are Huber et al.—U.S. Pat. No. 2,708,926 and Hollowell—U.S. Pat. No. 4,164,210.

Even though the principle of pulse combustion has been known for some considerable time, the various reactions that take place within the combustion chamber of a pulse cmbustion apparatus are not well understood. Specifically, debate continues as to the mechanism by which successive fuel charges are ignited spontaneously within the combustion chamber. A paper given at the Atlanta Pulse Combustion conference in March of 1982 by the present inventor, John A. Kitchen, and entitled "Pulsating Combustion Chambers for Heating Equipment" first suggested that flame in the combustion chamber is never completely extinguished and that successive fuel charges are ignited by this residual flame. The author concluded that control of the flow pattern of the incoming charge, in conjunction with the returning exhaust gases from the tail pipe are important for a stable combustion cycle and that variations in the operating frequency and some combustion failures could be attributed to the gas flow pattern in the combustion chamber during the first part of the cycle.

With this background, it is an object of the present invention to provide a pulse combustion apparatus capable of operating on a wide range of gas and liquid fuels.

DESCRIPTION OF THE INVENTION

The apparatus provided by the invention includes a combustion chamber having inlet means for fuel charges and an outlet for exhaust gases remote from the inlet means, an exhaust pipe extending from the exhaust gas outlet of the combustion chamber and forming a resonant system with the chamber and means operable to initiate combustion in the chamber. The fuel charge inlet means includes a plurality of one way air inlet valves which open and permit air to enter the combustion chamber during low pressure portions of successive pulst combustion cycles, and close during high pressure portions of said cycles, the valves including at least one primary air inlet valve. The inlet means also includes a fuel nozzle having a fuel inlet for connection to a fuel supply externally of the combustion chamber, and a fuel outlet. Means is provided removably supporting the nozzle with its fuel outlet in the combustion chamber adjacent said primary air inlet valve while permitting removal of the nozzle at appropriate times for replacement with a nozzle for a different fuel. Baffle means is provided within the combustion chamber and co-operates with the nozzle to define a metering orifice through which air entering the combustion chamber from the primary air inlet valve is constrained to flow. The nozzle support means is adapted to position the nozzle with respect to the baffle means to determine the size of the metering orifice according to the volume of primary air required to maintain continuous combustion commensurate with a pulse cycle of reasonable strength.

The invention is based on recognition that, while persistence of combustion is necessary for the ignition of successive charges, an excessive amount of continuous combustion will weaken the pulse cycle. Experiments conducted with No. 2 fuel oil atomized with proprietary air atomizing nozzles showed that these nozzles were unsatisfactory for pulse combustion due to the amount of continuous combustion resulting from the large amount of air used in atomizing the oil. The condition was corrected by modifying the nozzle to use less air but at higher pressure. It follows that different amounts of air are required for different fuels and it was recognized that a pulse combustion apparatus capable of burning a wide range of different fuels (e.g. gas, No. 2 fuel oil, Bunker C oil) must have a primary air supply which is adjustable according to the particular fuel being burned.

In practice, it is envisaged that a series of different nozzles will be provided for different fuels and that arrangements will be made so that, when each nozzle is installed, the baffle means and nozzle will together define the required size of metering orifice according to the particular fuel to be burned and its means of atomization. For example, No. 2 fuel oil would preferably be atomized by air (although steam atomization could be used) and would require little primary air if any. Bunker C oil is preferably steam atomized (although air atomization could be used) and a relatively large primary air supply would be required. Gas would require some primary air but less than with oil fuels. In all cases, the primary air supply will be controlled to ensure that residual flame fronts will remain in the combustion chamber through successive combustion cycles but that the amount of continuous combustion will not be so excessive as to weaken the pulse cycle.

Secondary air for the main combustion process will enter the combustion chamber through other air inlet valves externally of the baffle means. Normally, the volume of air admitted through the secondary combustion air inlet valves will significantly exceed the volume of primary air required.

BRIEF DESCRIPTION OF THE DRAWINGS

In order that the invention may be more clearly understood, reference will now be made to the accompanying drawings, which illustrate a preferred embodiment of the invention by way of example, and in which.

DESCRIPTION OF THE PREFERRED EMBODIMENT

Figure 1:
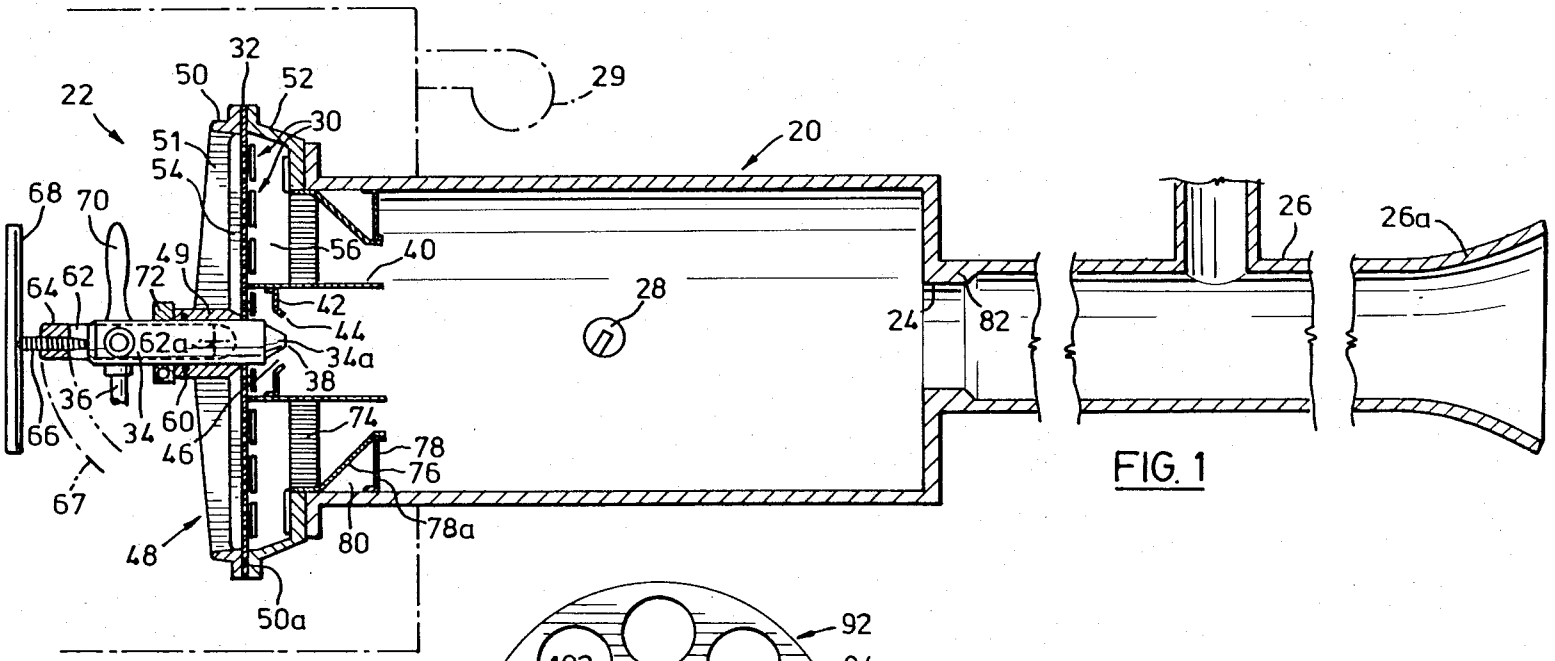
FIG. 1 is a longitudinal sectional view through a pulse combustion apparatus in accordance with the invention.

Referring first to FIG. 1, a pulse combustion apparatus is shown to comprise a cylindrical combustion chamber 20 having at one end inlet means generally denoted 22 for fuel charges and, at the opposite end, an outlet 24 for exhaust gases. An exhaust pipe 26 extends from the exhaust gas outlet 24 and forms a resonant system with the combustion chamber. Reference numeral 28 indicates a spark plug in the combustion chamber for initiating combustion. Suitable electrical equipment (not shown) will be provided for providing a spark at plug 28 as is well known in the art. Once initiated, combustion is of course self-sustaining and the spark plug 28 is no longer needed. It is also conventional to use a blower to deliver combustion air to the combustion chamber under pressure for starting. Typically, an enclosure such as that indicated in ghost outline in FIG. 1 will surround the inlet means 22 and a blower 29 will be coupled to the enclosure.

Figure 2:
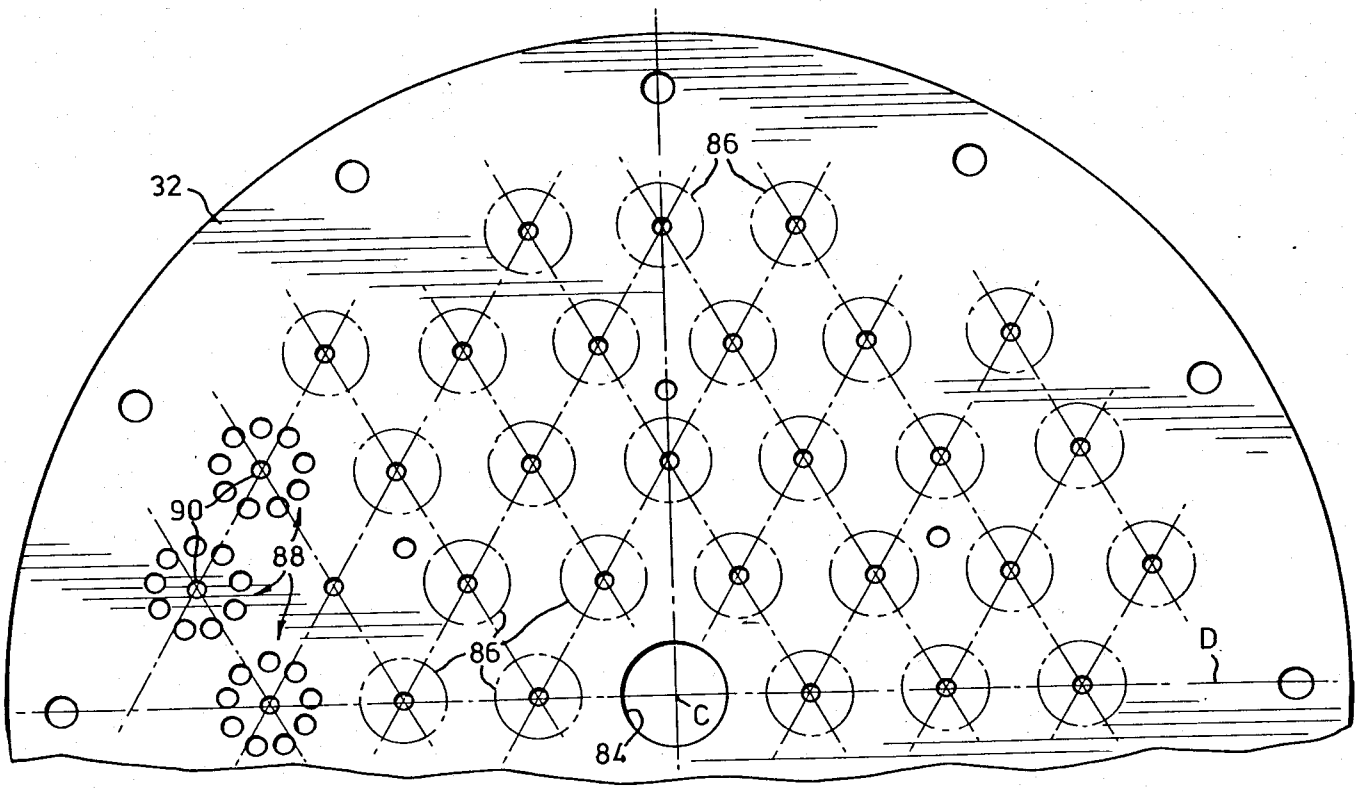
FIG. 2 is an elevational view of a valve plate used in the apparatus of FIG. 1.

The fuel charge inlet means 22 includes a series of pressure responsive air inlet valves which are individually indicated by reference numeral 30 and which are carried by a valve plate 32. FIG. 2 shows part of plate 32 and it will be seen that the plate is circular and that the valves 30 are generally distributed around a central location as will be more specifically described later. At the centre of plate 32 is a fuel supply nozzle 34 having a fuel inlet 36 externally of the combustion chamber and a fuel outlet 38 within the combustion chamber.

The air inlet valves 30 are divided into primary and secondary air inlet valves by a cylindrical baffle 40 that extends into the combustion chamber from valve plate 32 generally coaxially with both the fuel supply nozzle 34 and the combustion chamber 20. In FIG. 2, the position of baffle 40 is indicated by a dotted line. Although FIG. 2 is only a partial view of plate 32 it will be appreciated that six of the air inlet valves 30 are disposed within the baffle 40 while the remainder are external to the baffle. Those valves within the baffle are considered as primary air inlet valves and supply air for maintaining continuous combustion within the combustion chamber. The remaining valves admit secondary air for sustaining the main combustion process.

Extending inwardly from baffle 40 is a generally annular shaped baffle 42 having a central opening 44 around which the baffle is flared in a direction away from valve plate 32, i.e. towards the centre of the combustion chamber. The leading end of the fuel nozzle 34 around fuel outlet 38 is of frusto-conical shape as indicated at 34*a*, and the flared portion of baffle 42 generally follows the shape of this portion of the nozzle. Baffle 42 co-operates with the nozzle 34 to define a metering orifice 46 through which air entering the combustion chamber from the primary air inlet valves is constrained to flow. By appropriately selecting the size of this orifice, the volume of primary air being delivered into the combustion chamber is controlled. Clearly, if nozzle 34 were moved to the left in FIG. 1 the size of the orifice would increase while if the nozzle were moved to the right, the size of the orifice would decrease. The intention is that different nozzles, as nozzle 34, will be provided for different fuels and each nozzle will be arranged to lie in a predetermined axial position with respect to baffle 44 to provide a metering orifice 46 of the required size.

This is achieved as follows:

Fuel supply nozzle 30 is of cylindrical shape and is disposed at the centre of a housing 48 at the inlet end of the combustion chamber. Housing 48 has a central boss 49 through which the nozzle extends, an annular member 50 at the perimeter of the housing and a series of spaced radial members 51 (in this case six) that extend between boss 49 and member 50. Combustion air enters between the radial members 51. Valve plate 32 is in effect trapped between a peripheral face 50*a* on member 50 and a corresponding face on a intermediate annular member 52 that supports housing 48 at a spacing from the relevant end of the combustion chamber proper. Housing 48 and member 52 define respective areas 54 and 56 upstream and downstream of the valve plate 32.

In summary, nozzle 34 is in effect supported with respect to the combustion chamber by the housing 48. The nozzle is a sliding fit in the boss 49 at the centre of housing 48 and an annular sealing ring 60 is provided within the boss for sealing against the external surface of the nozzle. A U-shaped yoke is pivotally coupled adjacent its ends to boss 49 but is partly concealed by the nozzle in FIG. 1. Part of one limb of the yoke is visible at 62; its pivot to boss 49 is denoted 62*a*. Located between the two limbs of the yoke is a boss 64 having a screw-threaded opening receiving a screw 66 that bears against the outer end of nozzle 34. A T-handle 68 is provided at the outer end of screw 66 for speed of turning. By loosening screw 66, the yoke can be swung downwardly as indicated at 67, permitting nozzle 34 to be axially withdrawn from its opening in boss 49. A handle 70 is provided on nozzle 34 for ease of manipulation.

In the installed position as shown, screw 66 bears against the outer end of nozzle 34 for ensuring that the nozzle is fully seated in its operative position. That position is defined by an external collar 72 on nozzle 34 that bears against the boss 49 of housing 48. Each nozzle for each different type of fuel will have a similar collar as collar 72 and the position of each collar will be selected to determine the required axial position of the leading end 34*a* of the nozzle and hence the size of the metering orifice 46 for the primary air. In an alternative embodiment, it would be possible to provide for manual adjustment of the axial position of the nozzle but is generally considered preferable that the position of the nozzle should be fixed, once a nozzle has been set for proper operation.

An annular flame trap 74 is provided around the cylindrical baffle 40 and extends out to the wall of the combustion chamber. The flame trap is essentially of conventional form and is designed to permit air to flow through the flame trap from the valves 30 while preventing transmission of flame in the reverse direction when the valves are closed.

Immediately downstream of the flame trap 74 in the direction of air flow into the combustion chamber is a peripheral baffle 76 of frusto-conical shape that extends inwardly of the combustion chamber so as to tend to direct incoming secondary air towards the centre of the chamber. Returning combustion gases entering the combustion chamber through outlet 24 will likewise tend to be directed to the centre of the combustion chamber and will meet the incoming secondary air as well as the primary air and fuel, which are also directed centrally of the chamber. It is anticipated that the result of this tendency of the combustion air and fuel to flow in the central region of the combustion chamber towards the returning exhaust gases will have the effect of causing, in effect, a collision of the opposing flows in the centre region of the combustion chamber with consequent high turbulence and good mixing which is believed to be desirable for a strong cycle. Typical anticipated flow patterns have been generally indicated in FIG. 1.

Extending outwardly from the innermost edge of baffle 76 to the wall of the combustion chamber body is an annular plate 78 and the space between this plate and the baffle is filled with insulation as indicated at 80. The outer face 78*a* of plate 78 is coated with a refractory material or the plate may be made of stainless steel. The presence of insulation in the space between plate 78 and baffle 76 allows the plate 78 to maintain a high temperature during combustion, unaffected by the effect of incoming air that cools baffle 76. The high temperature maintained by plate 78 allows burn-off of carbon that would otherwise tend to accumulate on baffle on 76 and/or on the valves 30 upstream of the flame trap. The area 56 between the flame trap and the valves should ideally be kept to a minimum volume so as to minimize the possibility of blow back of gases that could carry carbon into the valves during the high pressure portions of the pulse combustion cycles.

The exhaust pipe or tail pipe 26 of the apparatus comprises a plain cylindrical pipe, the outer end portion 26*a* of which is flared to provide for smooth entry exhaust gases and air during the compression part of the pulse combustion cycle. A restriction denoted 82 is placed at the outlet 24 of the combustion chamber to increase the velocity of the returning gases as they enter the combustion chamber. This increase in velocity increases the turbulence within the combustion chamber and consequently the rate of combustion, with a corresponding increase in the amplitude of the pulse cycle. Alternatively, a tapered exhaust pipe can be used with the small end at the combustion chamber but this is both expensive to manufacture and unnecessary for this class of equipment.

Figure 4:
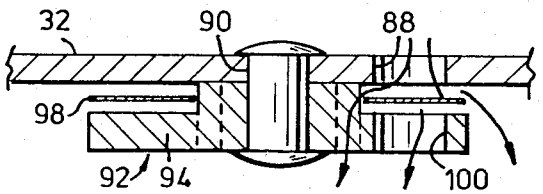
Figure 3:
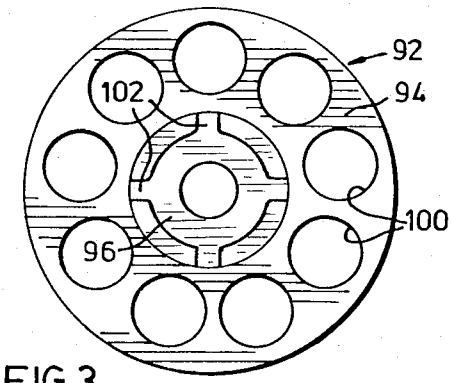
FIG. 3 is an elevational view of a valve retainer used in the apparatus of FIG. 1; and, FIG. 4 is a detail sectional view showing the retainer of FIG. 3 in position on the valve plate of FIG. 2.

Reference will now be made to FIGS. 2, 3 and 4 in describing the valves used in pulse combustion apparatus. All of valves are essentially the same whether used for controlling primary air or secondary air. The valves are all pressure responsive one-way diaphragm valves of the type that have been proven to give good service in small pulse combustion heating equipment. Scaling up these valves for large industrial combustors is difficult due to the required open area and the fact that the valves lose their efficiency when the travel of the diaphragm becomes excessive (greater than about 0.060 inches). The present invention provides the necessary open area by employing a large number of small valves positioned in a 60° triangular pattern based on a diameter of the valve plate. This has been found to provide a maximum open area for a given size of valve and valve plate.

The valve plate itself is illustrated in FIG. 2 and as can be seen is circular. A diametral line is indicated at D and passes through the centre C of the plate. A large circular opening 84 is provided at the centre of the plate to receive the fuel nozzle 34. Each of the large circles denoted 86 in effect represents one valve and a series of nine small circular openings are spaced around this large circle to provide air inlet openings through the valve plate. Those series of openings have been shown at three valve locations at the left hand side of FIG. 2; similar series of openings will be provided on each of the circles 86 but have not been shown for ease of illustration. A somewhat smaller circular opening 90 is provided at the centre of each circle 86 but is not used as an air flow opening.

It will be seen from FIG. 2 that each of the circles 86 is centred on a 60° triangular pattern using the diameter line D as a base line and starting from the centre C. A similar pattern of openings is provided on the other half of the plate, which is not shown in FIG. 2.

FIG. 3 shows a valve retainer which is used below each of the series of openings 88 in valve plate 32 while FIG. 4 shows a typical retainer assembled to the valve plate. The retainer itself is denoted 92 and essentially comprises a disc-shaped portion 94 and a boss 96 that projects outwardly to one side of the disc-shaped portion as best shown in FIG. 4. The boss is secured to the valve plate 32 by a rivet that extends through a central opening in the boss and through the opening 90 at the centre of the circular series of openings in the valve plate. As a result, the disc-shaped portion 94 of the retainer is spaced from the valve plate and an annular valve member 98 (diaphragm) floats freely in that space. The openings 88 in the valve plate are disposed above valve member 98 while similar openings 100 are provided in the retainer below the valve member.

As can be seen from FIG. 1, the valve retainers 92 are at the combustion chamber side of the valve plate in the assembled apparatus. Accordingly, during high pressure portions of the pulse combustion cycle the pressure in the combustion chamber acts on the valve members and member 98 (FIG. 4) to force the valve member upwardly as drawn and close the openings 88. Conversely, during the depression part of the cycle, the valve member 98 is drawn downwardly so that the openings 88 are no longer obstructed and air can be drawn into the combustion chamber. The boss 96 of the valve retainer is joined to the disc-shaped portion 94 by four limbs 102, the outer edges of which effectively guide the valve member 98 in moving between its open and closed positions. In the open position of the valve air can flow both outwardly around the perimeter of the valve member 98 and inwardly through the spaces between these limbs 102, which makes for good distribution of air into the combustion chamber.

The apparatus shown in the drawings is of the so-called "in line" type in which the fuel charge inlet is generally on the same axis as the exhaust. This configuration is geometrically well suited to industrial applications in which ease of installation is a prime concern. While a pulse combustion apparatus of the form provided by the invention can have many applications, some of which are indicated below, the particular form of apparatus shown in the drawings has been designed for use as a dehydrator for moisture containing fluent material such as food products (e.g. tomato paste), grain, animal wastes etc. Indicated in ghost outline in FIG. 1 is an inlet to the exhaust pipe 26 of the apparatus through which such material can be introduced into the apparatus for drying. Material introduced in this way is subjected to the very high temperatures of the exhaust gases and is rapidly dried and expelled from the apparatus through the exhaust pipe. An apparatus for this purpose may have a heat output capacity of the order of 3 million BTUs/hr but it is believed that units having a capacity as high as 10 million BTUs/hr can be constructed.

Other examples of applications for this type of apparatus are for boiler firing, either as a water jacketed part of the boiler or as a combustion unit installed in the fire box of the boiler, reduction of ore or other material requiring a high temperature in the presence or absence of oxygen, and snow melting or removal by blast effect. U.S. Pat. No. 2,748,753 (Sarrazin et al.) shows an example of an installation in which multiple combustion units can be used in parallel, in this case as parts of a boiler.

It will of course be undertood that the preceding description relates to a particular preferred embodiment of the invention and that many modifications are possible. For example, valves other than the pressure responsive diaphragm valves disclosed may be used. Examples of other types of valves are butterfly valves or rotary valves. These or other alternatives may be appropriate for larger scale pulse combustors. It should also be noted that the particular configuration of combustion chamber disclosed, while preferred for ease of installation of the apparatus is not essential within the broad scope of the invention.

When the apparatus is used with a low pressure gas supply, it may be necessary to provide a gas cushion chamber upstream of the fuel nozzle, and an associated valve to isolate the gas cushion chamber during high pressure portions of successive cycles, for example as disclosed in U.S. Pat. No. 2,898,978 (Kitchen et al.).

I claim:

1. A pulse combustion apparatus comprising:

a combustion chamber having inlet means for fuel charges and an outlet for exhaust gases remote from the inlet means;

an exhaust pipe extending from said exhaust gas outlet and forming a resonant system with the combustion chamber; and, means operable to initiate combustion in said chamber;

wherein said fuel charge inlet means comprises:

a plurality of one way air inlet valves which open and permit air to enter the combustion chamber during low pressure portions of successive pulse combustion cycles, and close during high pressure portions of said cycles, said valves including at least one primary air inlet valve;

a fuel nozzle having a fuel inlet for connection to a fuel supply externally of the combustion chamber, and a fuel outlet;

means removably supporting the nozzle with its fuel outlet in the combustion chamber adjacent said primary air inlet valve, while permitting removal of the nozzle at appropriate times and replacement with a nozzle for a different fuel;

baffle means within the combustion chamber cooperating with said nozzle to define a metering orifice through which air entering the combustion chamber from the primary air inlet valve is constrained to flow;

said nozzle support means being adapted to position the nozzle with respect to said baffle means to determine the size of said metering orifice according to the volume of primary air required to maintain continuous combustion commensurate with a pulse cycle of reasonable strength.

2. An apparatus as claimed in claim 1, wherein said inlet valves are arranged in a generally circular pattern with the fuel nozzle at the centre, and wherein a series of said primary air inlet valves are arranged around said nozzle and surrounded by said baffle means, while a series of secondary air inlet valves are arranged around said baffle, whereby, in operation, fuel and primary air enters the combustion chamber generally centrally of and surrounded by a secondary air flow.

3. An apparatus as claimed in claim 2, wherein said combustion chamber is of cylindrical shape extending about a longitudinal axis, and wherein the inlet valves are arranged in said circular pattern at one end of the combustion chamber with the fuel nozzle disposed generally on said axis, and wherein the exhaust gas outlet of the combustion chamber is also disposed generally on said axis at the end of the combustion chamber opposite the inlet valves.

4. An apparatus as claimed in claim 2, wherein said inlet valves include a common valve plate formed with groups of openings, one for each valve, a valve retainer for each valve coupled to the valve plate at the combustion chamber side thereof, and a pressure responsive diaphragm for each valve retained by said retainer and movable in response to pressure changes within the combustion chamber between a closed position in which the diaphragm overlies and obstructs said openings, and an open position, and wherein said baffle means comprise a first, generally cylindrical baffle extending into the combustion chamber from said valve plate and surrounding the fuel nozzle and primary air inlet valves, and a second, generally annular baffle extending inwardly from said first baffle and co-operating with the fuel nozzle to define said metering orifice.

5. An apparatus as claimed in claim 4, wherein said groups of openings are arranged on the valve plate with the centre of each group on a 60° triangular pattern based on a diameter line of the plate and starting with the centre of the plate, with said fuel nozzle disposed at said centre.

6. An apparatus as claimed in claim 4, further comprising a flame trap extending between said first baffle and the cylindrical wall of the combustion chamber for preventing blow back of flame to the inlet valves.

7. An apparatus as claimed in claim 6, further comprising an external baffle of frusto-conical shape extending inwardly from said cylindrical wall of the combustion chamber downstream of the flame trap in the direction of air flow into the combustion chamber, for deflecting secondary air entering the chamber generally towards the centre thereof.

8. An apparatus as claimed in claim 7, further comprising an annular plate extending between the cylindrical wall of the combustion chamber and the inner peripheral edge of said frusto-conical baffle, whereby the plate and baffle define therebetween a space, said space receiving thermal insulation means arranged to permit said plate to maintain a high temperature independent of the cooling effect on said baffle of secondary combustion air entering the combustion chamber, said plate being adapted to permit carbon accumulating on said plate to burn off under the effect of the high temperature gases in said combustion chamber.

9. An apparatus as claimed in claim 1, wherein said fuel charge inlet means includes a housing and wherein said means removably supporting the fuel nozzle includes a portion of said housing defining an opening in which the nozzle is slideably received, the nozzle being provided with external stop means co-operable with the housing for defining an installed position of the nozzle in which the nozzle is appropriately positioned with respect to said baffle means to define said metering orifice, and removable clamp means maintaining the nozzle in said installed position, whereby said nozzle can be withdrawn from said opening and removed after release of said clamp means, and replaced by a different nozzle having external stop means located to appropriately position that nozzle with respect to said baffle means.

10. An apparatus as claimed in claim 1, further comprising a restriction at the position of said exhaust gas outlet from the combustion chamber for accelerating exhaust gases returning to said chamber from the exhaust pipe during low pressure portions of successive pulse combustion cycles.

11. An apparatus as claimed in claim 1, wherein said exhaust pipe is outwardly flared at least at its outer end to provide for smooth entry of exhaust gases and air during low pressure portions of successive pulse combustion cycles.

* * * * *